United States Patent [19]

Schroder

[11] Patent Number: 4,711,324

[45] Date of Patent: Dec. 8, 1987

[54] SERVICE INDICATING DEVICE FOR ELEVATORS

[75] Inventor: Joris Schroder, Lucerne, Switzerland

[73] Assignee: Inventio AG, Switzerland

[21] Appl. No.: 36,562

[22] Filed: Apr. 8, 1987

[30] Foreign Application Priority Data

Apr. 14, 1986 [CH] Switzerland ..... 01477/86

[51] Int. Cl.[4] ..... B66B 3/00

[52] U.S. Cl. ..... 187/135; 187/137

[58] Field of Search ..... 187/127, 130, 135, 137

[56] References Cited

U.S. PATENT DOCUMENTS 4,555,000 11/1985 Umeda ..... 187/127

FOREIGN PATENT DOCUMENTS 53-549 1/1978 Japan ..... 187/135
53-36855 4/1978 Japan ..... 187/135
54-124460 9/1979 Japan ..... 187/135

*Primary Examiner*—William M. Shoop, Jr.
*Assistant Examiner*—W. E. Duncanson, Jr.
*Attorney, Agent, or Firm*—Marshall & Melhorn

[57] ABSTRACT

An indicating device for which the passengers waiting at a floor can recognize immediately whether the calls entered by them at the floor for desired destination floors have been assigned to an arriving car so that rapid entry decisions can be taken. To this purpose, the indicating device includes a first and a second indicator element in the form of an upward and a downward arrow, and a third indicator element signaling an entry prohibition. A floor circuit connected with the indicator by way of three inputs activates through the first and second inputs, the first and the second indicator elements respectively, if the entered calls are assigned to the arriving car, and by way of the third input activates the third indicator element, if the entered calls have not been assigned to a car arriving at a floor.

9 Claims, 5 Drawing Figures

SERVICE INDICATING DEVICE FOR ELEVATORS

BACKGROUND OF THE INVENTION

The invention relates in general to an indicating device for the elevators of a group of elevators and, in particular, to indicator elements at the floors which indicate to the passengers waiting at the floors whether the desired destination floor can be reached with an arriving car.

U.S. Pat. No. 3,374,864 discloses a group èlevator control in which the desired destination floor can be entered at the floor of entry. For this purpose, call buttons for every floor are arranged at the floors, while no call buttons are provided in the car. The control operates in such a manner, that the car specified for a destination floor indicates, on arrival at the floor of entry, the destination floor number by means of an optical indicating device so that passengers will not enter erroneously who wish to go to other destination floors. In this group control conceived for three floors and two elevators, the indicating device has to indicate solely the numbers of two floors, which can be easily comprehended by waiting passengers. For larger installations with many floors, an indicating device of this type has to be designed for the appropriate number of floors, so that the reading of the indicating device, especially in case of heavy traffic and cars of great capacity, will demand increased attention of the passengers, will take longer and will make rapid entrance decisions impossible.

On elevators with call buttons arranged in the car, as described for example in the German document No. 1 773 352, open for inspection, it is known to arrange directional arrows above or near the floor door, which light at the arrival of a car at a floor and indicate the direction of the continuing trip. Such indicating devices make it known to the waiting passengers at a first glance, whether the continued travel direction of the car corresponds with desired direction of travel, so that rapid entrance decisions can be taken. However, this type of indication is not suited for controls according to the above described art.

The problem is to create an indicating device for group elevator controls in which passengers waiting on a floor are able to recognize, without effort, even in the case of larger elevator installations and heavy traffic, whether the calls entered by them for destination floors have been assigned to an arriving car.

SUMMARY OF THE INVENTION

The above problem is solved by the present invention which includes an indicating device consisting of a first and a second indicating element in the shape of an upward and a downward pointing arrow respectively, as well as a further indicating element signaling an entry prohibition. A circuit connected with the indicator activates the first or the second indicating element, if the calls entered on this floor for desired destination floors are assigned to a cabin arriving at this floor. The further indicating element is activated if the calls entered on this floor for desired destination floors are not assigned to a cabin arriving at this floor.

As can be seen, the upward and downward pointing arrows of the indicating device according to the invention have a considerably extended power of information. In combination with the further indicating element, the advantages realized with the invention are therefore, that in the case of larger elevator installations and a heavy amount of traffic, the passengers waiting at a floor can recognize immediately whether an arriving car can service the entered calls for desired destination floors, so that rapid entry decisions can be taken. Since the indicating device, independently of the number of floors, can function with only three indicating symbols, it can be designed more cost efficiently than an indicating device showing the floor numbers.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
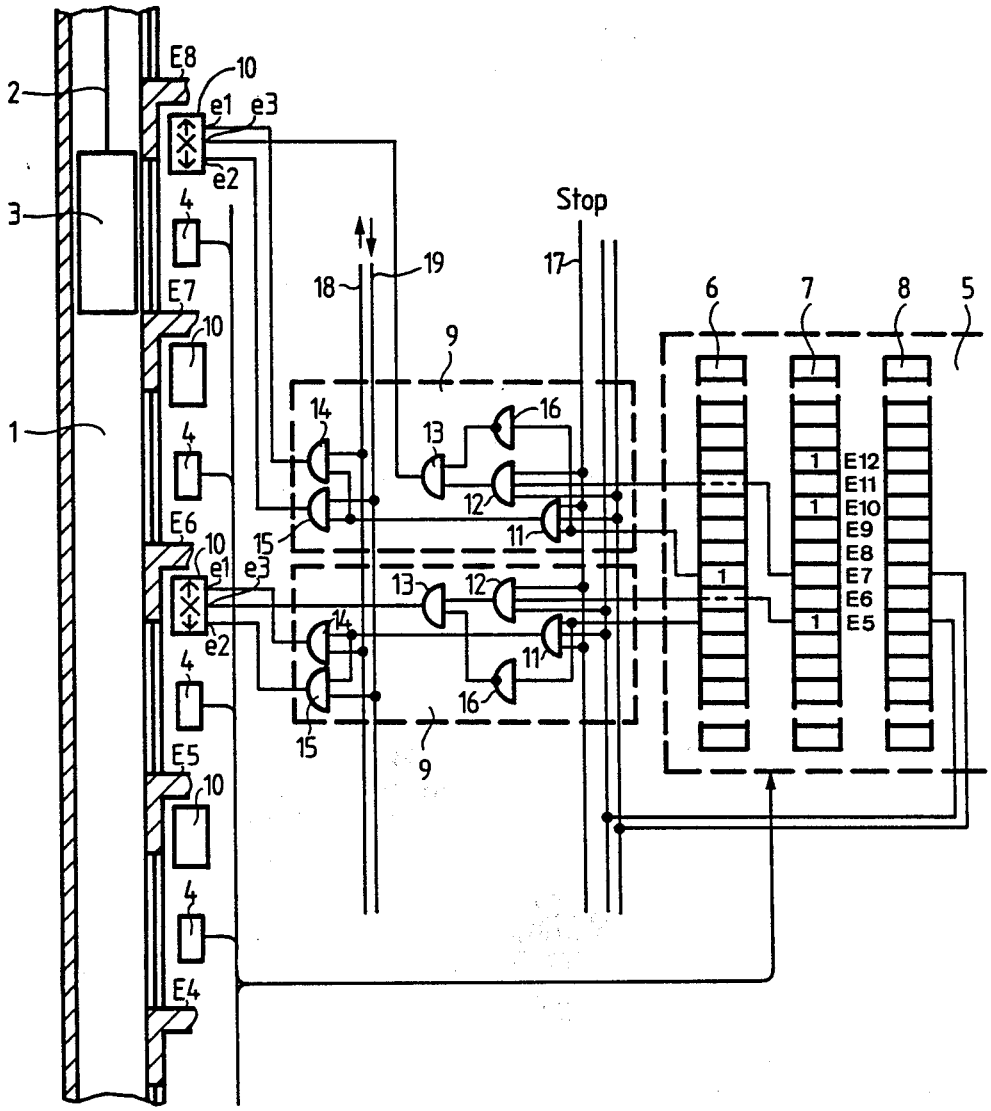
FIG. 1 is a schematic representation of an elevator in a group of elevators utilizing the indicating device according to the present invention.

In FIG. 1, a section of an elevator shaft 1 comprising for example five floors E4 - E8 of an elevator group consisting of several elevators, includes a car 3 driven through a hoisting cable 2. Provided on the floors are call registering devices 4, which have call buttons arranged in the shape of a ten key keyboard, by means of which calls for trips to desired destination floors can be entered. On entering a call, a car call designating the destination floor and a floor call designating the entering floor are stored. The call registering devices 4 are connected with a group control device 5, of which only the one part assigned to the elevator 3 of the group is shown, comprising a floor call memory 6, a car call memory 7 and a selector 8. As is known, the selector 8 signals in each case that floor at which the travelling car 3 could still stop in case a stop command existed. The group control device 5, which is similar to the group control device proposed by European patent No. 0 032 213, works in a manner that newly arriving calls are assigned in each case to those cars which can service these calls in the shortest period of time.

Circuits 9 are assigned to each floor, which floor circuits are connected on the input side with the group control device 5 and on the output side with indicators 10 arranged on the floors. The circuits 9 shown only for the floors E5 and E7, consist of first and second AND-gates 11 and 12 each having three inputs, and third, fourth and fifth AND-gates 13, 14 and 15 each having two inputs and a NOT-gate 16. The first and second AND-gates 11 and 12 are connected through one input each with an output of the selector 8 assigned to the corresponding floor, and through another input each with a conductor 17, which during a stop at a floor carries a stop signal. By way of a third input, the first AND-gate 11 is connected to the output of a storage unit, assigned to the respective floor, of the floor call memory 6. The third input of the second AND-gate 12 is connected with the output of a storage unit, assigned to the same floor, of the car call memory 7.

The output of the first AND-gate 11 is connected with one input of each of the fourth and fifth AND-gates 14 and 15. The other input of the fourth AND-gate 14 is connected to a conductor 18 carrying an upward-continued trip signal, while the other input of the fifth AND-gate 15 is connected with a conductor 19 carrying a downward-continued trip signal. The output of the fourth AND-gate 14 is connected with a first input e1, and the output of the fifth AND-gate 15 is connected with a second input e2 of the indicator 10. The one input of the third AND-gate 13 is connected to the output of the second AND-gate 12, while the other input, through the NOT-gate 16, is connected to the output of a storage unit, assigned to the respective floor, of the car call memory 6. The output of the third AND-gate 13 is connected with a third input e3 of the indicator 10.

Figure 2:
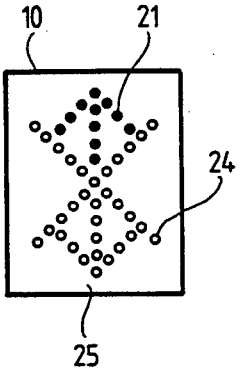
FIG. 2 is a schematic representation of an indicator of the indicating device of FIG. 1 on activation of a first indicating element.
Figure 3:
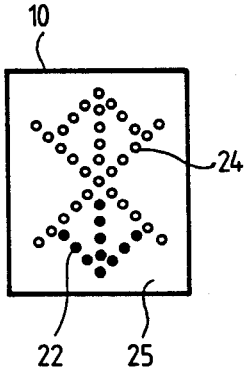
FIG. 3 is a schematic representation of the indicator of FIG. 2 on activation of a second indicating element.
Figure 4:
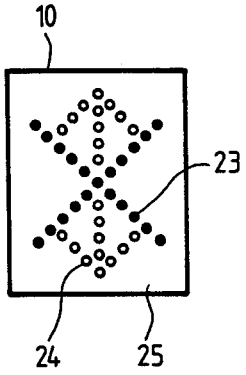
FIG. 4 is a schematic representation of the indicator of FIG. 2 activation of a further indicating element.
Figure 5:
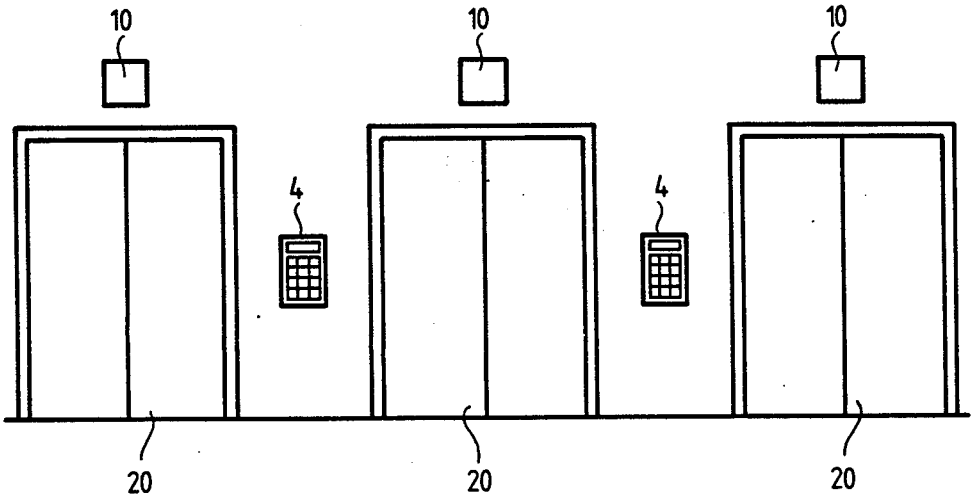
FIG. 5 is schematic representation of an arrangement of the pushbuttons and indicators of the indicating device according to the present invention on a floor in an elevator group consisting of three elevators.

As shown in FIGS. 2–4, the indicator 10 consists of a first and a second indicating element 21 and 22 in the shape of an upward and a downward arrow respectively, and a further indicating element 23 signaling an entrance prohibition in the shape of an X-sign. The indicating elements 21, 22 and 23 are formed by light emitting diodes (LED's) 24, which are attached to a printed circuit board (not shown) and are covered by means of a plate 25 perforated corresponding to the indicating symbols. On activation of the indicating elements 21, 22 and 23, through the corresponding inputs e1, e2 and e3 (FIG. 1), the first and second indicating elements 21 and 22 light up green and the further indicating element 23 lights up red. 20 in FIG. 5 designates the floor doors, between which the call register devices 4 are arranged. The indicators 10 are preferably attached above the floor doors 20.

The indicating device described above works as follows: It shall be assumed that the car 3 of an elevator of the elevator group in the course of its upward travel was assigned a floor call for floor E7 and two calls entered at that floor for destination floors E10 and E12. These calls, stored in the floor and car call registers respectively, are designated in the FIG. 1, with the customary logic symbolism "1". Since at the stop of the car 3 on floor E7 according to the logic chosen as an example, the selector signal, the stop signal and the upward-continued travel signal are logic "1", the first indicating element 21 is activated by way of the first and fourth AND-gates 11 and 14 and the first input e1 of the indicator 10. Hereby the upward arrow 21 lights up green, whereby it is indicated to the waiting passengers that the car 3 will service the calls entered by them.

As a further example, it shall be assumed that due to a car call the car 3 has to stop at floor E5 during a downward trip (FIG. 1). Because the selector and stop signals are by then logic "1", and because the output of the storage unit of the floor call memory 6 assigned to the floor E5 is logic "0", the further indicating element 23 is activated by way of the second AND-gate 12, the NOT-gate 16, the third AND-gate 13 and the third input e3 of the indicator 10. At this time, the X-sign 23 lights up red, whereby it is indicated to the passengers waiting on floor E5 that they are not allowed to enter, because the calls entered by them were not assigned to this car.

As an extension of the above described example, it shall be assumed that car 3 was also assigned a floor call for floor E5 and a call entered at this floor for destination floor E3. Since in this case the selector and stop signals, the downward-continued trip signal, and the output of the storage unit assigned to the floor E5 of the floor call memory 6 are logic "1", the second indicating element 22 is activated by way of the first and fifth AND-gates 11 and 15 and the second input e2 of the indicator 10. With this, the downward arrow lights up green, whereby it is indicated to the passengers waiting on floor E5 that the car 3 will service the call entered by them.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An indicating device for the elevators of an elevator group, the elevator group including call register devices located on the floors for entering the calls for desired destination floors, and a group control device for assigning the calls to the cars of the elevator group, and where indicators are provided at the floors, which indicate to the passengers waiting at the floors, whether the desired destination floor can or cannot be reached with the arriving car, the indicating device comprising:

a first, a second and a third indicator element, said first and second indicator elements in the form of an upward and a downward arrow respectively, and said third indicator element shaped for signalling an entry prohibition, and a floor circuit connected by a first and a second input for activating said first and second indicator elements if the calls entered at an associated floor for desired destination floors are assigned to a car arriving at that floor, and said floor circuit connected by a third input for activating said third indicator if the calls entered at that floor for desired destination floors are not assigned to a car arriving at that floor.

2. The indicating device according to claim 1 wherein said third indicator element is formed in the shape of an X-sign.

3. The indicating device according to claim 1 wherein said first, second and third indicator elements are formed by light emitting diodes and where on activation the light emitting diodes of the first and second indicator elements light up green, and the third indicator element lights up red.

4. The indicating device according to claim 1, wherein the group control device includes per elevator of the elevator group a floor call memory, a car call memory and a selector; wherein said floor circuit consists of first and second AND-gates each having three inputs, third, fourth and fifth AND-gates each having two inputs and a NOT-gate; wherein said first AND-gate is connected on an input side with the floor call memory, the selector and a conductor carrying a stop signal at the stop of the car, and on an output side is connected with an input of each of said fourth and fifth AND-gates, the other inputs of said fourth and fifth AND-gates are connected with a conductor carrying an upward-continued travel signal and a conductor carrying a downward-continued travel signal respectively, and an output of each is connected to said first and second inputs of said indicator elements respectively; wherein at a stop of the car on a floor call and in response to a continued travel signal, one of said first and the second indicating elements is activated; wherein said second AND-gate is connected on an input side with the car call memory, the selector and the conductor carrying a stop signal in response to a stop of the car, and is connected at an output side with an input of said third AND-gate, the other input of which is connected by way of said NOT-gate with the floor call memory, and an output of which is connected to said third input of said indicator elements; and wherein at a stop of the car after a car call and in response to the absence of a floor call for the same floor said third indicator element is activated.

5. In a group elevator control apparatus including call register devices located on the floors for entering calls for desired destination floors, and a group control device having a floor call memory, a car call memory and a selector for each car in the group, an indicating device comprising:

first, second and third indicator elements having first, second and third inputs respectively, said first and second indicator elements being formed as upward and downward arrows respectively, and said third indicator element shaped for signalling an entry prohibition; and a floor circuit having first through fifth AND-gates and a NOT-gate connected together, inputs connected to a floor call memory, a car call memory and a selector, and outputs connected to said first, second and third inputs of said indicator elements whereby said floor circuit responds to calls entered in the floor call memory for desired destination floors assigned to a car arriving at a floor for signalling at one of said first and second inputs of said indicator elements for activating said first and second indicator elements.

6. The apparatus according to claim 6 wherein said floor circuit signals at said third input for activating said third indicator element in response to calls entered in the floor call memory for desired destination floors not assigned to a car arriving at the floor.

7. The apparatus according to claim 5 wherein said third indicator element is formed in the shape of an X-sign.

8. The apparatus according to claim 5 wherein said first and second indicator elements light up green upon activation and said third indicator element lights up red upon activation.

9. The apparatus according to claim 5 wherein said first AND-gate is connected at three inputs with the floor call memory, the selector and a conductor carrying a stop signal in response to a stop of the car and has an output connected with an input of each of said fourth and fifth AND-gates; said fourth and fifth AND-gates each have another input connected with a conductor carrying an upward-continued travel signal and a conductor carrying a downward-continued travel signal respectively and each having an output connected to said first and second inputs of said indicator elements respectively; said second AND-gate is connected at three inputs with the car call memory, the selector, and said conductor carrying said stop signal and has an output connected to an input of said third AND-gate; and said third AND-gate has another input which is connected through said NOT-gate with the floor call memory and has an output connected to said third input of said indicator elements.

* * * * *